US005117773A

United States Patent [19]

Papajewski et al.

[11] Patent Number: 5,117,773

[45] Date of Patent: Jun. 2, 1992

[54] DEVICE FOR THE LUBRICATION OF THE ROTATING HOOK IN A SEWING MACHINE

[75] Inventors: Reinhold G. Papajewski, Stutensee, Fed. Rep. of Germany; Donald M. Millett, Gorham, Me.

[73] Assignee: The Reece Corporation, Waltham, Mass.

[21] Appl. No.: 597,547

[22] Filed: Oct. 12, 1990

[51] Int. Cl.[5] ..... D05B 71/02

[52] U.S. Cl. ..... 112/256

[58] Field of Search ..... 112/256, 181, 183, 184, 112/228, 189, 43

[56] References Cited

U.S. PATENT DOCUMENTS

| | | | |
|---|---|---|---|
| 2,531,362 | 11/1950 | Parry | 112/256 |
| 2,848,967 | 8/1958 | Nicolay | 12/256 |
| 3,060,877 | 10/1962 | Ketterer | 112/256 |
| 3,068,820 | 12/1962 | Ketterer et al. | 112/256 |
| 3,272,164 | 9/1966 | Keller | 112/256 |
| 3,955,520 | 5/1976 | Gebhardt | 112/256 |

FOREIGN PATENT DOCUMENTS 2607279 1/1979 Fed. Rep. of Germany .

*Primary Examiner*—Peter Nerbun

*Attorney, Agent, or Firm*—McAulay Fisher Nissen Goldberg & Kiel

[57] ABSTRACT

A lubrication device for a rotating hook in a sewing machine, having a hook shaft provided with a hollow interior axially thereof, an inlet and an outlet communicating with the hollow interior for prevention of oil pressure build-up therein as oil is supplied from an oil reservoir, a restriction between the inlet and the outlet for decreasing the diametrical extent of the hollow interior, and a closure for one end of the hollow interior provided with an oil supply channel communicating with the hollow interior, the oil supply channel having an axis positioned either eccentrically or concentrically of a longitudinal axis of the hook-shaft and an insert part to prevent the porous material from resting at the bottom of the interior of the hook-shaft, when the machine is stopped.

20 Claims, 2 Drawing Sheets

DEVICE FOR THE LUBRICATION OF THE ROTATING HOOK IN A SEWING MACHINE

SUMMARY OF THE INVENTION

1. Background of the Invention

This invention relates to a device for lubricating a rotating hook for a sewing machine.

The rotating hook of a sewing machine requires lubrication with oil in order to reduce wear of the hook. The oil-supply for the hook requires adjustment to a certain, specific amount, which has to be constant during the working-cycle of the sewing machine.

As is well-known to those skilled in the art, if the oil-supply exceeds this specific amount, the hook is then supplied with too much oil, and this results in an oily thread and leads to sewing problems. On the other hand, if the oil-supply is insufficient, the hook gets too hot and excessive wear results.

Various different designs have been developed for the automatic hook lubrication especially through a rotary hook-shaft.

2. Description of Prior Art

German Patent No. 2607279 makes use of gravity force for hook lubrication. This system, however, requires a specially designed hook. In the aforesaid device for hook lubrication of a rotating sewing machine hook, the bottom part 5 of the hook and cylindrical side wall 6 form a chamber 7 for the spool. The hook has a ring-shaped hollow chamber 17 which functions in connection with a ring 18 as an oil chamber. Oil is pressed from centrifugal forces through a connecting pipe 21 to the bottom 5 of the hook and from there to the section 8 which has to be lubricated. Set screw 23 controls the amount of oil which is supplied to the bottom of the hook 5.

In order to control the amount of oil, connecting pipe 21 is partly surrounded by bore 22 which has a bigger diameter and a set screw 23, with which the connecting pipe can be deviated and is located orthogonally to the axis of the hook.

SUMMARY OF THE INVENTION

The basis for the invention is a hook lubrication device wherein the outer surface of the hook-shaft is shaped as a spiral. Oil is delivered through an inlet by a wick to the outer diameter or surface of the hook-shaft and a spiral positioned on the outer circumferential surface of the hook-shaft, and an opening in the hook-shaft in connection with a hook-shaft bushing which transports the oil into the hollow hook-shaft. As there is no bypass or outlet, a pressure builds up in the interior of the hook-shaft. Oil metering is accomplished by a needle valve. This prior art design, as well as all the others, basically have two main problems:

1. The metering of oil to the hook is a very sensitive procedure, because the metering is sensitive to the opening of the needle valve, and therefore, it is necessary to use highly precise parts; and, even with the use of precise parts, the adjustment is very difficult, even under normal operational conditions.

2. The spiral, in connection with the bushing, pumps oil and air which results in different pressure values in the hook-shaft depending on the oil supply to the outer diameter of the hook-shaft.

With only oil in the hook-shaft the pressure is relatively high. With an oil-air mixture, the pressure level is much lower.

If the metering device (for example a needle valve) is now adjusted for the high pressure with only oil in the hook-shaft and an air-bubble develops suddenly in the hook-shaft the result is a stoppage of the oil supply to the hook. If the metering device is set to an oil-air mixture, and the air leaves the system the result is an excessive oil supply to the hook.

Briefly, all existing hook-lubrication devices do not assure a constant oil-supply at a set level which is easy to adjust.

SUMMARY OF THE INVENTION

With the present invention, it is desired to overcome the aforesaid difficulties by providing a device which permits an adjustable and constant oil-supply to the rotating hook in a sewing machine.

Briefly, according to the invention this can be achieved by designing a hook-shaft with an inlet and an outlet connected to an oil reservoir so that a pressure build-up in the hook-shaft is prevented. Furthermore the inner diameter of the hollow hook-shaft is decreased slightly in a certain area of the shaft between the oil-inlet and oil-outlet; and the oil-supply-channel is located at the end of the shaft close to the hook, and it is located eccentrically to the shaft axis. This guarantees or provides assurance that a specific oil supply depending on various fixed design parameters, such as a decrease in the diameter of the hook-shaft diameter, and the eccentricity of the oil-supply-channel, etc. With this embodiment no adjustment of the oil-supply is possible.

However, the device operates satisfactorily, once the oil-supply level is set in accordance with pre-determined design parameter.

The oil-supply-adjustment can be achieved by adding a block of porous matter which is inserted into the shaft close to an oil-supply-channel which then can be pressed or pressured by means of a screw.

A further feature of the invention and a further advantage is the improvement in the adjustment device. This is accomplished in two ways:

1. Control of the sewing machine so that it can be stopped in a position whereby the oil-supply-channel is located in the upper part of hook-shaft, and an insert portion is arranged in such a manner that the porous material block does not touch the oil that collects in a lower part of the hook-shaft. This, in effect, assures a stopping of the hook supply of the hook-oil supply when the sewing machine is stopped. This is an optimum solution for sewing machines having a relatively long operational cycle.

2. A further solution according to the invention is to locate the oil-channel in the axis of the hook-shaft for machines with a short sewing cycle.

To these ends, the invention consists in a device for the lubrication of a rotating hook in a sewing machine, and includes a hook-shaft having a hollow interior axial thereof with an inlet and an outlet communicating with the hollow interior of the hook-shaft for prevention of oil build-up therein as oil is supplied from an oil reservoir, and a portion between the inlet and the outlet for decreasing the diametrical extent of the hollow interior.

One end of the hollow interior is provided with an oil supply channel communicating with the hollow interior, and the oil supply channel has an axis positioned eccentrically to the longitudinal axis of the hook-shaft.

In one preferred embodiment, the hook-shaft is associated with means for stopping the hook-shaft with the oil-supply channel positioned in the upper part of the hook-shaft.

It is also desirable to have a porous material located within the hollow interior at one end of the hook-shaft and positioned adjacent to the closure.

The porous material in a preferred embodiment is positioned adjacent to the closure, and an insert part positioned therewith beneath the porous material for holding thereof adjacent to an upper portion of the wall of the hollow interior when the sewing machine is stopped to prevent the porous material from coming into contact with a lower portion of the hollow interior.

Further features are to provide the inner surface of the hook-shaft with spiral grooves or with a roughened surface. Also, one end of the hollow hook-shaft is closed off and provided with an oil supply channel having an axis concentric with the longitudinal axis of the hook-shaft, and the porous material positioned is within the hollow interior adjacent to the closed off end of the hollow hook-shaft.

In another embodiment, a spring is provided surrounding the porous material. The surface of the porous material which contacts the oil is therefore enlarged.

DESCRIPTION OF THE PREFERRED EMBODIMENTS

Figure 1:
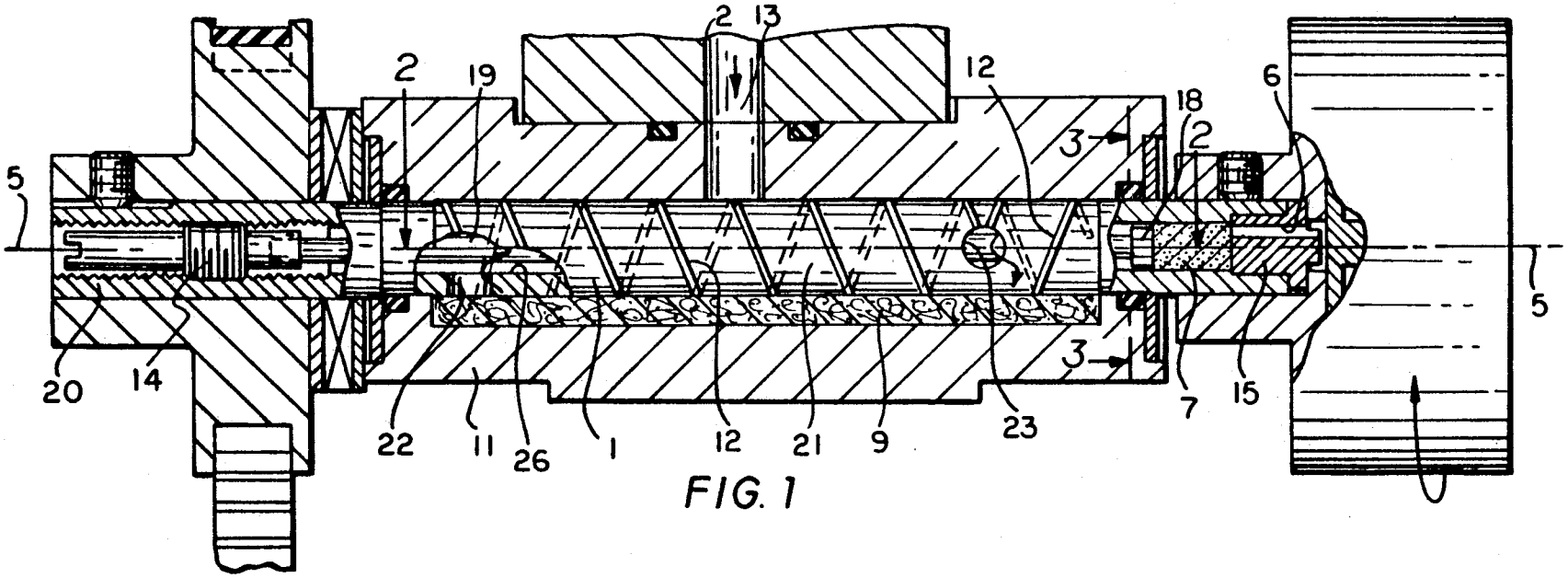
FIG. 1 is a cross-sectional view of one embodiment of the hook-shaft and the hook-shaft-bushing.
Figure 2:
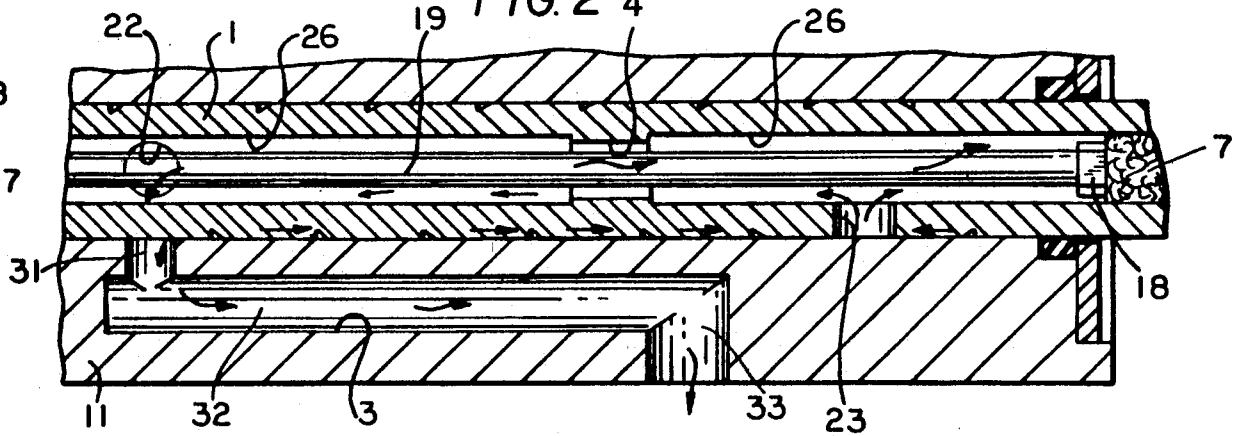
FIG. 2 is a sectional view taken along the line 2—2 of FIG. 1.
Figure 3:
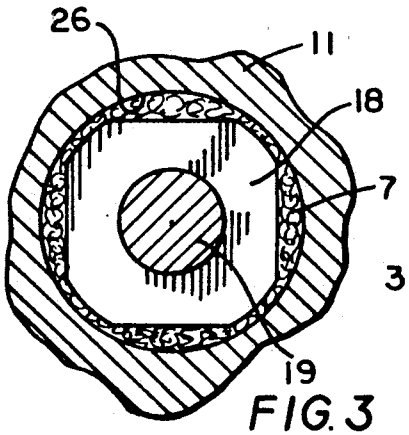
FIG. 3 is a cross-sectional view of taken along the line 3—3 of FIG. 1.

Referring now more particularly to FIGS. 1 to 3 of the drawings which show our presently preferred mode of carrying out the invention with a hook-shaft 1 shown in cross-section positioned within a bushing 11 which is provided with lubrication inlet 2 and lubrication outlet 3, spaced from each other. Positioned between lubrication inlets 2 and 3 is a hook shaft oil inlet 23 within bushing 11. The arrows in inlet 2 and outlet 3 show the direction of flow. Oil flows into inlet 2 in a direction transverse to hook shaft axis 5, and out from outlet 3 through oil-flow paths or conduits 31, 32 and 33. Conduits 31 and 33 are transverse to hook shaft axis 5, and conduit 32 is substantially parallel to hook shaft axis 5.

Hook-shaft 1 is provided with a hollow interior and has a reduced area portion 4 positioned between hook-shaft inlet 23 and hook-shaft outlet 22. Oil from lubrication inlet 2 passes through wick 13 in inlet 2 and flows between bushing 11 and hook shaft 1 to inlet 23 through shaft 19 to hook shaft outlet 22 to outlet 3 through conduits 31, 32 and 33.

In FIGS. 1 to 3, one end of the hollow channel is closed off by an adjustment screw 14 having its head closing off the left-hand side of the hook-shaft, as shown in the drawing, and its shank or shaft portion 19 extending through the interior of the hook-shaft and being sufficiently narrowed to extend past the reduced area portion 4. The other side of hook-shaft 1 is provided with a closure wall and closure member 15 having an oil supply channel 6. The oil supply channel 6 has a longitudinal axis which is eccentric to or displaced from the axis of hook shaft 1. In this embodiment oil-supply-channel 6 is neither co-axial with nor aligned with longitudinal axis 5 as will be explained subsequently during the explanation of the operation.

As a further feature of the invention, a plug of porous foam material 7 is placed within a bore 26 of the hook-shaft 1, and is held in place against closure member 15 by means of pressure member 18 carried at the end of shaft 19 coupled with screw 14.

Screw 14 cooperates with the interior of hook-shaft 1 at the left-end 20 thereto as viewed in the drawing to maintain porous material 7 juxtaposed to closure member 15. Depending on the pressure on the porous material, the oil supply to the oil supply channel can be regulated. Outer portion of hook-shaft 1 is provided with a spiral undercut 12 which works in connection with bushing 11 as a pump.

Figure 4:
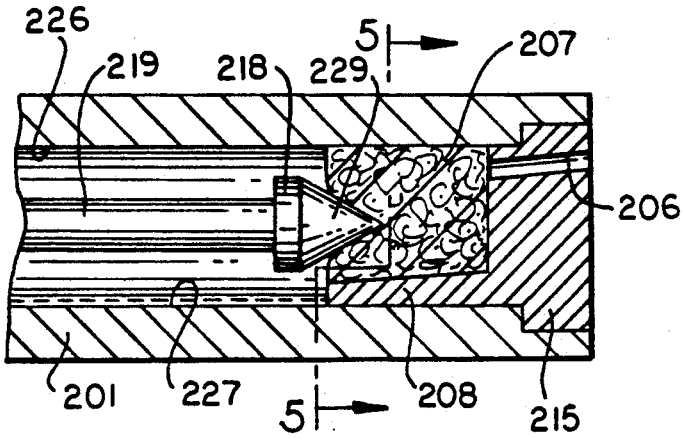
FIG. 4 is a partial sectional view similar to FIG. 2 of another embodiment with the porous material and the insert part holding the porous material in place.
Figure 5:
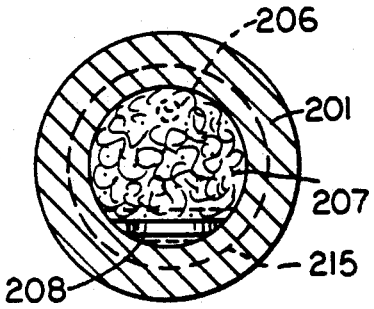
FIG. 5 is a sectional view taken along the line 5—5 of FIG. 4.

Referring now more particularly to FIGS. 4 and 5, which show another embodiment of the invention, like parts will be designated by adding the number 200, and as shown, hook-shaft 201 is provided with closure member 215 having an eccentric oil supplying channel 206. Porous material 207 is shown somewhat differently from porous material 7 and an insert part 208 is provided. The porous material is held against the closure member 215 by means of pressure member 218 which is shown with a pointed end 229. Pressure member 218 is connected with shaft 219. In order to maintain the porous material raised above the bottom portion 227 of interior bore 226 of the hollow shaft 201, there is insert part 208.

Insert part 208 can be made from metal, plastic or any other type of solid material. The purpose of insert part 208 is to prevent the porous material 207 from soaking up oil which collects in the bottom of the hollow hook-shaft, if the machine is stopped in the position shown in FIG. 3.

Figure 6:
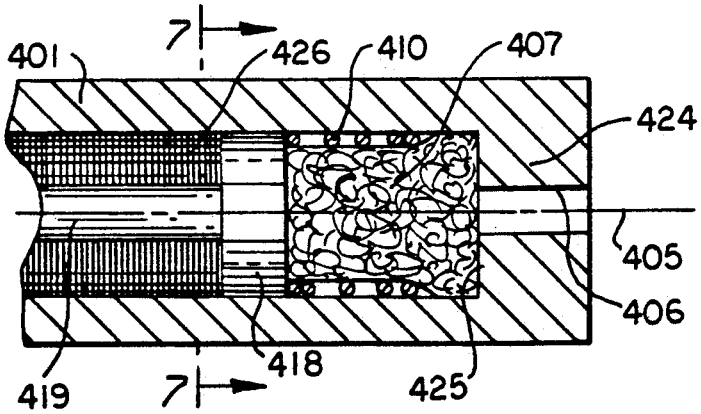
FIG. 6 is a partial sectional view similar to FIG. 4 of another embodiment with one end of the hook shaft closed, but with the oil feed hole coaxial with the hollow hook-shaft, and the porous material surrounded by a coil spring.
Figure 7:
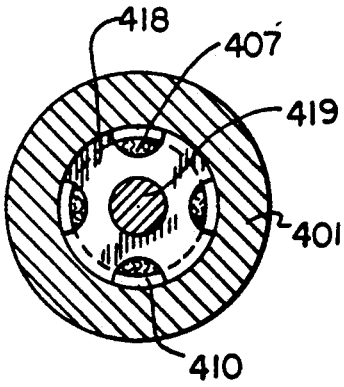
FIG. 7 is a sectional view taken along the line 7—7 of FIG. 6.

Referring now more particularly to FIGS. 6 and 7 of the drawings, there is shown a hook-shaft 401 which is closed at end 424. Closed end 424 is provided with an oil supply channel 406 co-axially positioned and aligned with the longitudinal axis 405 of hook-shaft 401 and provided with a spring 410 wound about the outer circumferential surface of porous material 407. It is to be understood that there is an oil inlet and an outlet (not shown) similar to that shown in FIGS. 1 and 2. Shaft 419 contains pressure member 418 to hold porous material 407 under pressure and in place against the inner portion 425 of closed end 424, and to press or depress porous material in order to control oil supply to oil supply channel 406.

DESCRIPTION OF OPERATION

FIGS. 1 to 3 show a cross-sectional view of the hook-shaft 1 with bushing 11. Spiral groove 12 cut into the outer surface of the hook-shaft 1 causes oil to be pumped from wick 13 which is inserted in inlet 2 of bushing 11 and connected with oil reservoir 9 and hook-shaft inlet 23 into hollow hook-shaft 1 through outlet 22, while the machine is running. The centrifugal force distributes the oil as a thin film onto the inner surface 26 of hook-shaft 1. The decreased diameter of hook-shaft 1 in the reduced area 4 works as a control for the quantity of oil available for hook oiling.

The spiral undercut 12, as best seen in FIGS. 1 and 2 is triangular. The spiral on the outer surface of the hook-shaft pumps oil from inlet 2 through hook-shaft inlet 23 into hollow hook shaft 1.

If the oil film becomes too thick, excessive oil crawls over the shoulder in reduced area 4 towards hook-shaft outlet 22 and flows back through outlet 3 to an oil reservoir (not shown); another part of this oil is immediately transported by spiral 12 to inlet 23 and then back into the hollow hook-shaft.

Therefore, the FIGS. 1 to 3 embodiment achieves a constant amount of oil available for hook oiling depending on the location of reduced area 4 and the decreased diameter thereof.

Furthermore, the inner surface 26 of the hook-shaft 1 can be roughened or provided with grooves in order to control crawling-speed of the oil. The oil crawls due to centrifugal force to the oil-supply-channel 6 and finally reaches the hook. The oil supply to the hook also depends on the diameter of the oil-supply-channel 6 and its location.

As the hook-shaft 1 revolves, the spiral 12 on its outer surface 21 pumps oil through the inlet 23 into the hollow hook-shaft. The pump effect is stronger than the centrifugal force. As soon as the oil enters the hollow hook-shaft, an oil film develops under the centrifugal force on the inner surface 26. The oil, therefore, is driven along the inner surface of the hook-shaft to the left and the right of inlet 23 (see FIG. 1). The barrier in area 4 stops the oil from crawling to the left. Therefore, the oil film becomes thicker until the thickness of the oil film exceeds the barrier in area 4 and crawls to outlet 22 (the reason for this crawling effect is the centrifugal force). Depending on the increased diameter of the hollow hook-shaft in area 4 (design parameter), the thickness of the oil film can be factory set. The speed with which the oil crawls on the inner surface of the hook-shaft, under the influence of the centrifugal force, depends on the inner surface 26 of the hook-shaft. Therefore, a means to control the crawling speed of the oil is to roughen the inner surface 26 or provide it with spiral grooves. The above-described design therefore assures a constant thickness of the oil film in the hook-shaft.

Depending on the location of the oil supply channel 6, a design parameter, and the set thickness of the oil film, the amount of oil with which the hook is supplied can be a factory set design parameter.

However, this embodiment of the idea does not allow to adjust the oil supply. By inserting a piece of porous material 7 which can be pressed or depressed, the oil supply can be adjusted. In this embodiment, during machine standstill, the porous material 7 soaks up the oil which collects in the lower part of the inner hook-shaft. A solution is to stop the machine in a position where the oil supply channel is located in the upper part of the hook-shaft and an insert part 208 is arranged in the lower part of the hook-shaft to prevent the porous material from soaking up oil during machine standstill.

The FIGS. 1 to 3 embodiment of the invention, as noted, also works quite well without the block of porous material 7. However, it is preferred to use the block of porous material 7. It is important, when the sewing machine is stopped, that the oil-supply-channel 6 be located in the upper part of the hook-shaft 1 as shown in FIG. 1. This maintains the oil which collects when the machine is stopped in the lower part of the hook-shaft 1 and prevents the oil from flowing through the oil-supply-channel 6.

The block of porous material 7 which can be pressed by adjustment screw 14 operates as an oil-supply adjustment device in the FIG. 1 embodiment. When adjustment screw 14 and porous material 7 are pressed together, less oil is supplied to the hook and when released more oil is supplied. This adjustment device for certain purposes may not provide sufficient control and may cause porous material 7 to soak up oil when the machine stops, and therefore the hook may be supplied with excessive oil when the machine starts again.

The rough surface 426 (FIG. 6) is the result of machining a very fine spiral groove along the inside surface of the hollow hook-shaft 401. The spirals on the inside and the rough surface of the inside of shaft 1, 201 or 401 allow a more precise control of the oil flow in the inside of the hollow hook-shaft.

An improved embodiment for an adjustment device according to the invention is shown in FIGS. 4 and 5. In this embodiment, insert part 208 maintains and prevents porous material 207 from touching the oil which collects in the lower part or portion of the hook-shaft 1 when the sewing machine stops. For this purpose, insert part 208 plays an essential part. The two design possibilities permit the supplying of the hook-shaft with oil during the entire sewing machine operation cycle.

In FIGS. 6 and 7, the block of porous material 7 which is designated 407 is surrounded by spring 410 according to the invention. Certain parts are omitted from FIGS. 6 and 7 but, if they were shown, they would be designated with numbers in the 400 range. This arrangement assures that the porous material 407 regains its original shape after the screw 14 in FIG. 1, which would be designated 414 in FIGS. 6 and 7, is screwed outwards so that the soaking of oil is performed faster and referring to pollution of the oil the required function of the porous material 407 provided for increased time of usage.

An additional spring 410 which surrounds the porous material 407 assures that the material depresses properly and increases the outer surface of the porous material. The embodiment shown in FIGS. 6 and 7 shows the oil channel 406 located concentrically with the hook-shaft axis 405. With the oil supply channel 406 located as described, oil will only be supplied to the hook during the start phase. During the running phase, the centrifugal force presses the oil against the inner surface of the hook-shaft and, therefore, no oil will be supplied through oil channel 406. This embodiment can therefore only be used in machines with a short sewing cycle. However, a positioning of the oil channel after machine stop is not necessary.

The FIGS. 6 and 7 embodiment is primarily intended for an adjustment device according to the invention which supplies the hook with oil only during machine start so that it will be sufficient for a short operation cycle. Oil-supply-channel 406 is arranged concentrically to the hook-shaft-axis 405. During machine stoppage, the porous material 407 soaks up oil and supplies the hook with oil during the machine's start-up time. During machine operation, the hook is not supplied with oil. Therefore, this device should primarily and preferably only be installed in machines with a relative short operation cycle.

While there has been shown what is considered to be the preferred embodiments of the invention, it will be obvious to those skilled in the art that various changes and modifications may be made therein without departing from the scope of the invention.

We claim:

1. A device for the lubrication of a rotating hook in a sewing machine, comprising:

a hook shaft having a hollow interior axially thereof;

inlet means and outlet means freely communicating with the hollow interior of said hook shaft for prevention of oil pressure build-up therein as oil is supplied from an oil reservoir to said hollow interior through said inlet means and free of any pressure control of the oil as it flows out of said outlet means; and a particular means between said inlet means and said outlet means for decreasing the diametrical extent of said hollow interior, the diameter of said hollow interior on each side of said particular means being substantially co-extensive.

2. The device of claim 1, including a closure for one end of said hollow interior having an oil supply channel communicating with said hollow interior, said oil supply channel having an axis positioned eccentrically of a longitudinal axis of said hook shaft.

3. The device of claim 2, including means associated with said hook shaft for positioning said oil-supply channel in the upper part of said hook shaft.

4. The device of claim 1, including a porous material located within said hollow interior at one end of said hook shaft.

5. The device of claim 4, wherein said porous material is positioned adjacent to said closure.

6. The device of claim 2, including a porous material positioned adjacent to said closure, and an insert path positioned beneath said porous material for holding thereof adjacent to an upper portion of the wall of said hollow interior when the sewing machine is stopped to prevent said porous material from coming into contact with a lower portion of said hollow interior.

7. The device of claim 1, wherein the inner surface of said hook shaft is provided with spiral grooves, or a roughened surface for pumping oil into the hollow hook shaft.

8. The device of claim 1, wherein the outer surface of said hook shaft is provided with a roughened surface for pumping oil into the hollow hook shaft.

9. The device of claim 1, wherein one end of said hollow hook shaft is closed off and is provided with an oil supply channel having an axis concentric with said longitudinal axis of said hook shaft.

10. The device of claim 1, including a porous material positioned within said hollow interior adjacent to a closed off end of said hollow hook shaft and a spring surrounding said porous material.

11. The device of claim 4, including a spring surrounded said porous material.

12. The device of claim 1, including a wick in said inlet means for delivery of a lubricant to the outer surface of said hook shaft.

13. The device of claim 1, including a porous material positioned adjacent to a closure for said hollow interior, and an insert part positioned beneath said porous material for holding thereof adjacent to an upper portion of the wall of said hollow interior when the sewing machine is stopped to prevent said porous material from coming into contact with a lower portion of said hollow interior and the there collecting oil and a pressure member for exerting pressure onto said porous material.

14. The device of claim 13, wherein at least one of the inner surface and the outer surface of said hook shaft is provided with spiral grooves or a roughened surface.

15. The device of claim 13, including a spring surrounding said porous material.

16. The device of claim 13, including a wick in said inlet means for delivery of a lubricant to the outer surface of said hook shaft.

17. A device for the lubrication of a rotating hook in a sewing machine, comprising:

a hook shaft having a hollow interior axially thereof;

inlet means and outlet means communicating with the hollow interior of said hook shaft for prevention of oil build-up therein as oil is supplied from an oil reservoir to said hollow interior through said inlet means;

means between said inlet means and said outlet means for decreasing the diametrical extent of said hollow interior;

one end of said hollow hook shaft being closed off and being provided with an oil supply channel having an axis concentric with said longitudinal axis of said hook shaft;

a porous material positioned within said hollow interior adjacent to said closed off end of said hollow hook shaft; and a spring surrounding said porous material.

18. The device of claim 17, including an insert part positioned beneath said porous material for holding thereof adjacent to an upper portion of the wall of said hollow interior when the sewing machine is stopped to prevent a lower portion of the hollow interior from contacting said porous material.

19. A device for the lubrication of a rotating hook in a sewing machine, comprising:

a hook shaft having a hollow interior substantially axially thereof;

an inner portion of said hook shaft between an inlet means and said outlet means having an inner diametrical extent less than the diametrical extent of the inner portions on each side of said inner portion; and means coupling said inlet means to an oil reservoir and fully communicating therewith for supplying oil to said hook shaft, thereby preventing oil pressure build-up therein as oil is supplied from said oil reservoir to said hollow interior through said inlet means and free of any pressure control of the oil as it flows out of said outlet means.

20. The device of claim 19, including porous means positioned within said hollow interior at one end of said hook shaft and means cooperating with said porous means for exerting pressure thereon.

* * * * *